United States Patent [19]

Ross et al.

[11] Patent Number: 5,027,112

[45] Date of Patent: Jun. 25, 1991

[54] GRAPHIC DISPLAY SYSTEMS

[75] Inventors: John Ross, Dalkeith; Amedeo F. Sala-Spini, Dianella, both of Australia

[73] Assignee: Ran Data Pty. Ltd., Perth, Australia

[21] Appl. No.: 86,045

[22] PCT Filed: Aug. 29, 1985

[86] PCT No.: PCT/AU85/00205

§ 371 Date: Jun. 29, 1987

§ 102(e) Date: Jun. 29, 1987

[87] PCT Pub. No.: WO87/01493

PCT Pub. Date: Mar. 12, 1987

[30] Foreign Application Priority Data

Aug. 20, 1985 [AU] Australia ..... 46526/85

[51] Int. Cl.[5] ..... G09G 3/26; G04C 17/00

[52] U.S. Cl. ..... 340/792; 340/815.03; 340/815.24

[58] Field of Search ..... 340/724, 756, 760, 762, 340/792, 726, 716, 815.01, 815.02, 815.03, 815.19, 815.24; 40/427, 442, 541; 362/227, 800, 812

[56] References Cited

U.S. PATENT DOCUMENTS

| | | | |
|---|---|---|---|
| 4,090,187 | 5/1978 | Kreinik | 340/792 |
| 4,112,424 | 9/1978 | Lapeyre | 340/762 |
| 4,162,493 | 7/1979 | Ross et al. | 340/755 |
| 4,240,074 | 12/1980 | Gibson et al. | 340/792 |
| 4,344,622 | 8/1982 | Nissim | 340/792 |
| 4,358,761 | 11/1982 | Iwasaki | 340/792 |
| 4,365,245 | 12/1982 | Colmenero | 340/792 |
| 4,449,123 | 5/1984 | Muranaga | 340/716 |

FOREIGN PATENT DOCUMENTS

| | | | |
|---|---|---|---|
| 493435 | 6/1978 | Australia . | |
| 2144254 | 2/1985 | United Kingdom | 340/792 |

*Primary Examiner*—Alvin E. Oberley
*Assistant Examiner*—M. Fatahiyar
*Attorney, Agent, or Firm*—Harness, Dickey & Pierce

[57] ABSTRACT

A display system is disclosed for depicting a moving image of a graphic representation of a sequence of, for example, letters, words, symbols or artwork. The system comprises a display area defined by an array of light emitting diodes (LED's) which form a matrix having a series of rows and columns. The LED's are arranged in rows parallel to the intended direction of movement of an image and the columns are arranged orthogonal to the intended direction of movement. The LED's are further arranged in first and second groups in an interlacing fashion, wherein successive LED's of the first and second groups are spaced apart by one or more columns which do not contain LED's.

A controller is further included for generating a plurality of electrical signals in sequential groups, each such group of signals representing encoded data of a sample portion of the graphic to be represented by one column of the matrix at a prescribed instant, and successive groups of the sets of data providing further encoded data of successive sample portions of the graphic to be represented by a column and successive prescribed instants. The system is capable of displaying high-definition graphics with only a fraction of the picture elements necessary in prior art systems, and yet which produces an image that does not tend to break up into momentary fragments, jitter, or wobble.

16 Claims, 4 Drawing Sheets

GRAPHIC DISPLAY SYSTEMS

This invention relates to improvements in graphic display systems.

The term graphic is defined to include sequences of any length made up from letters, words, numbers, idiographs, severally or in combination, symbols and artwork, in colour or in black and white, which can be defined by elements arranged in dot matrix form.

Australian Patent Specification No. 493435 (21004/76) has disclosed means whereby high definition graphics may be displayed using only a fraction of the picture elements necessary in prior systems. The previous invention capitalized on the fact, now established by scientific experiment, that the visual system of man can interpolate in space when visual mechanisms sensitive to motion are stimulated by stroboscopic sequences. Accordingly a viewer can be caused to see an entire image in motion when only fragments of it are displayed stroboscopically in sequences such as described in Patent Specification No. 493435 (21004/76).

The previous invention suffered from certain limitations and deficiencies, including:

(1) There was a tendency for the image to break up into the momentary fragments of the image which were being displayed at any instant;

(2) There was a tendency for the image to jitter, that is to wobble, on the axis orthogonal to the direction of motion of the image;

(3) There was a restriction on the spacing of picture elements to not more than 12 vacant element sites between any two sequential picture elements adjacent to each other in the direction of motion of the image; and (4) The display system was designed as a stand alone system and was not readily adapted for inclusion as an element in a network.

(5) The ability of the display system to display low resolution stationary graphics was severely impaired.

The object of the present invention is to provide a system or method in which some or all of the above limitations are substantially overcome.

In one form the invention resides in a display system for depicting a moving image of a graphic of the type hereindefined comprising:

(i) a display means having a display area and an activating means; said display area being defined by an array of elements arranged in the form of a matrix having a series of rows and columns, each element forming a cell of the matrix, said rows being arranged parallel to the intended direction of movement of said image and said columns being arranged orthogonal to said intended direction of movement; a first group of elements each having an image source associated therewith, to emit an image element being a portion of said graphic on activation thereof, said first group of elements located in selected rows of said matrix, wherein successive elements of said first group in the same row are spaced apart by one or more columns having blank elements in said same row which do not emit a said image element, and a second group of elements of similar formation to said first group of elements but located in other selected rows of said matrix, wherein said second group of elements are disposed in interlacing fashion relative to said first group such that one element of said second group is disposed intermediate to a pair of successive elements of said first group in an adjacent row to the row of said one element, and a cell occupied by an image source in one said group of elements partially overlaps with an immediately adjacent cell in the same column, said adjacent cell being defined by a blank element disposed in a row of another said group of elements; and said activating means being associated with each of said image sources to activate an image source in response to the generation of a corresponding electrical signal; and (ii) a controller means for generating a set of said electrical signal in sequential groups, each set providing encoded data of a sample portion of said graphic to be represented by one column of said matrix at a prescribed instant, and successive groups of said sets providing further encoded data of successive sample portions of said graphic to be represented by said one column at successive prescribed instants, the period between successive prescribed instants being a display state period of said image, said encoded data being sequentially provided to be represented by successive columns of said matrix at said successive prescribed instants, wherein only those rows of image sources within a column of said matrix are activated for which an electrical signal has been generated in accordance with said encoded data.

Preferably, the image sources are arranged in discrete lines within selected columns, orthogonal to the intended direction of movement of said image. In another form of the invention resides in a method of depicting a moving image of a graphic of the type herein defined on a display means having a display area being defined by an array of elements arranged in the form of a matrix having a series of rows and columns, each element forming a cell of the matrix, said rows being arranged parallel to the intended direction of movement of said image and said columns being arranged orthogonal to said intended direction of movement; a first group of elements each having an image source associated therewith, to emit a portion of said graphic on activation thereof, said first group of elements located in selected rows of said matrix, wherein successive elements of said first group in the same row are spaced apart by one or more columns having blank elements in said same row which do not emit a said image element, and a second group of elements of similar formation to said first group of elements but located in other selected rows of said matrix, wherein said second group of elements are disposed in interlacing fashion relative to said first group such that one element of said second group is disposed intermediate a pair of successive elements of said first group in an adjacent row to the row of said one element, and a cell occupied by an image source in one said group of elements partially overlaps with an immediately adjacent cell in the same column, said adjacent cell being defined by a blank element disposed in a row of another said group of elements; and said activating means being associated with each of said image sources to activate an image source in response to the generation of a corresponding electrical signal, the method comprising the steps of generating a set of said electrical signals in sequential groups, each set providing encoded data of a sample portion of said graphic to be represented by one column of said matrix at a prescribed instant, and successive groups of said sets providing further encoded data of successive sample portions of said graphic to be represented by said one column at successive prescribed instants, the period between successive prescribed instants being a display state period of said image, said encoded data being sequentially provided to be represented by successive columns of said matrix at said successive prescribed instants, wherein only those rows of image sources within a column of said matrix are activated for which an electrical signal has been generated in accordance with said encoded data.

The system may include means for storing messages to be displayed, bit maps of characters and graphics used to comprise messages, and means for acquiring messages from remote sources transmitted by telephone lines, radio or other carriers.

The invention will be better understood by reference to the following description of one specific embodiment when read in conjunction with the accompanying drawings, wherein.

The ensuing description is specifically involved with describing those improvements and modifications made to the invention described in Australian Patent Specification No. 493435 (21004/76) which characterise the present invention. Accordingly, for a complete discussion of the underlining theory of the "beta apparent movement" phenomenon which forms the basis of the present invention, and for a more in depth discussion of some of the finer utilitarian points of the operation and function of the invention, reference should be made to Australian Patent Specification No. 493435 (21004/76).

Figure 1:
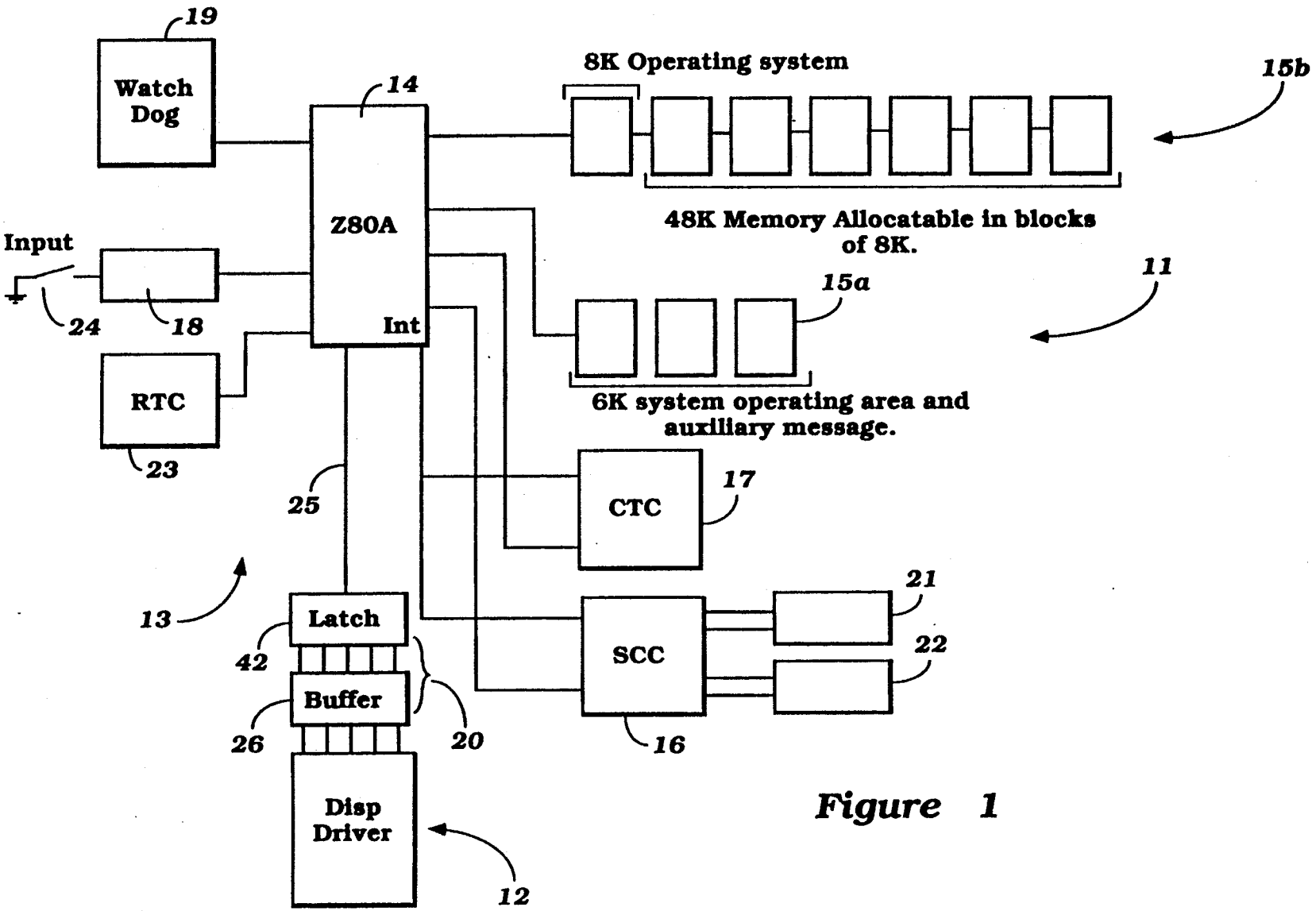
FIG. 1 is a block diagram of the complete display system.

The present embodiment is directed towards a display system, and exemplar version of which is shown at FIG. 1 of the drawings.

The display system 11 essentially consists of a display means 12 and a controller means 13.

The controller means has been developed to a rather sophisticated stage and comprises many features which have now become available as a result of advances in computer technology. The heart of the controller means is a computing means 14 and accompanied therewith an extensive memory means 15, a communication means 16, a timing means 17, an input interface 18, a watch dog circuit 19 and signal conditioning means 20 to interface with the display means.

The computing means 14 in the present embodiment is a Z80A CPU with normal clock circuit. The computing means performs most of the control functions of the system and co-ordinates activities between the accompanying circuits and the display means.

The memory means 15 is arranged into two distinct sections. One section 15*a* provides 6K of RAM and EEROM which accommodates the operating area used by the operating system and auxillary message for the computing means. The other section 15*b* provides an 8K operating system and a massive storage of relevant data to facilitate operation of the display system. This massive storage consists of 48K of memory allocated in blocks of 8K consisting of ROM, RAM or EEROM to suit the individual needs of a user of the system requiring the display of particular graphic information. Moreover, this memory particularly contains bit maps of a reference set of graphic characters in the form of groups of encoded data located within look-up tables. These would be stored in ROM and EEROM or the like. In addition, RAM memory may contain a text buffer for the desired graphics which are to be displayed and other operating information.

The communication means 16 is in the form of a serial communications controller (SCC) which is provided with two ports to receive communications from different sources. One port 21 is a modem port to receive communications from a remote location and the other port 22 is a local port to receive information from a local keyboard or other input device. The local port operation under either RS232 or RS432 for short or long haul operations.

The timing means 17 is in the form of a counter timer circuit (CTC) which provides accurate timing of input/output operations and particularly the cycle of a display state period. A further adjunct to the timing means of the present embodiment is a real time clock (RTC) 23 which enables the display means 12 to depict the current time if desired and/or effect control of desired functions of the display system with respect to a twenty-four hour clock.

The input interface 18 provides basic control of the display system by having a series of input switches 24 connected thereto to invoke basic control of the display means.

The watch dog circuit 19 performs a watch dog function by overseeing the operation of the computing means 14 thereby ensuring correct operation of the same, or otherwise applying a resetting pulse to the computing means to reset the same in the event of some malfunction.

Finally, encoded data is input to the display means via the data bus 25 and signal conditioning means 20 for operation of the display means 12, wherein such encoded data is obtained by using a conventional character generating technique with the RAM and ROM located in the 48K memory as previously described. The signal conditioning means is provided with a latch 42 and buffer 26 to accommodate changes in working voltage levels between the controller means 13 and the display means 12.

An important feature of the hardware design of the present system is that all timing is done under interrupt control. That is, the system is partitioned to allow the CTC 17 to perform accurate timing and signal the computing means 14 by way of an interrupt signifying the commencement or completion of a display state period or other such timing requirement. Furthermore, other peripheral devices such as the communication means 16, the RTC 23 and input interface 18 can communicate with the computing means by means of interrupts. However, to ensure that accurate timing is maintained, the CTC 17 is accorded the highest priority interrupt.

It should be appreciated, of course, that similar or alternative components may be employed to the hardware of the controller means as described above.

Now describing the display means, reference is made to FIGS. 2 to 5.

The display means 12 essentially consists of a display area 27 disposed within an appropriate housing, a series of image sources 28 in the form of LED's and activating means 29, which is associated with the latter.

The display area 27 is in the form of a rectangular panel and is divided up into an array of imaginary elements arranged in the form of a matrix having a series of rows and columns wherein each element forms a cell of the matrix. In the present embodiment, the rows extend in the horizontal direction of the display panel and the columns extend in the vertical direction. Furthermore, the rows are arranged parallel to the intended direction of movement of the image to be displayed on the display area, and the columns are arranged orthogonal to this intended direction of movement.

The image sources 28 are located in selected columns of the matrix and in the preferred arrangement are disposed in lines so that any image source located on the display area is disposed within a column having a series of other image sources therein. The image sources 28 are further arranged into first and second distinct groups. For simplicity of description, reference should be made to FIGS. 3 and 4 wherein the first group of elements having associated image sources shall hereinafter be referred to as the even group 30 and the second group of elements having associated image sources shall hereinafter be referred to as the odd group 31.

The distinguishing feature between the even and odd groups is that the even groups have image sources located in selected rows which in the present embodiment are the even rows of the matrix. On the other hand, the odd group has image sources located in other selected rows which in fact are the odd rows of the matrix. Thus as one proceeds from the first row of the matrix to the end row of the matrix the first row will contain image sources belonging to the odd group, and the second row will contain image sources belonging only to the even group. This continues in alternating fashion in seriatim until the end row of the matrix.

In any row of the matrix, succeeding elements therein which have an image source associated therewith are spaced apart in equal intervals by columns having non-image source, or blank, elements 28*a*, that is, elements not containing an image source therein. In the drawing shown at FIG. 3, the number of blank elements located between successive image sources in either group of elements is 9.

The characterisation of the present invention is related to the relative positioning of the image sources of the respective even and odd groups of elements. This is achieved by locating the respective groups of image sources in a coplanar interlacing fashion in the matrix. That is, each column of the odd group of elements, except maybe for the last column thereof in the matrix, is interposed between a pair of successive elements in a common row of the first group and vice versa. For example, column 32 containing an odd group of elements is interposed between columns 33 and 34 of the even group of elements. Furthermore, due to the alternating position of image sources being members of the odd group and even group of elements in successive rows, a cell of the matrix occupied by an image source in one group of elements can partially overlap with an immediately adjacent cell in the same column, wherein the adjacent cell is a member of a row containing image sources of the other group of elements. In addition, the immediately adjacent cells of an image source are defined by blank elements 28*a* to facilitate this overlapping effect.

Thus the present invention relies upon separating and mitigating the density of image sources within a column containing the same by alternating the rows of the column with elements containing an image source and blank elements. However, the image sources that would normally have been engrossed within the blank elements of a column of image sources, as described in Australian Patent Specification No. 493435 (21004/76), are separated out into an additional column positioned mid-way between succeeding columns of a group of elements. This further column would be of similar density of image sources to its adjacent colums but all columns are compensated for this reduced density by the improved spatial effect of the distribution of image sources.

Figure 2:
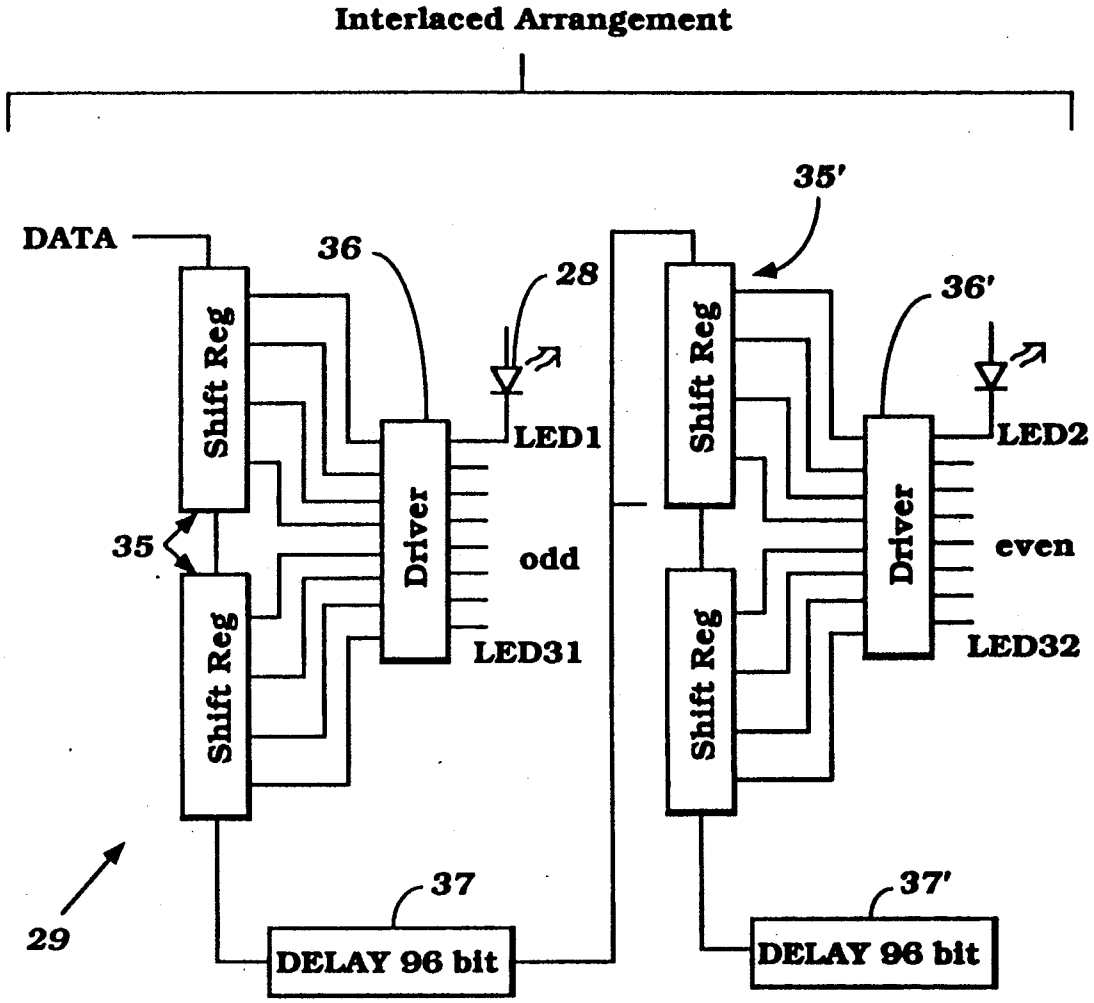
FIG. 2 is a block diagram of the preferred form of activating means for the interlaced arrangement in accordance with the present invention.
Figure 2A:
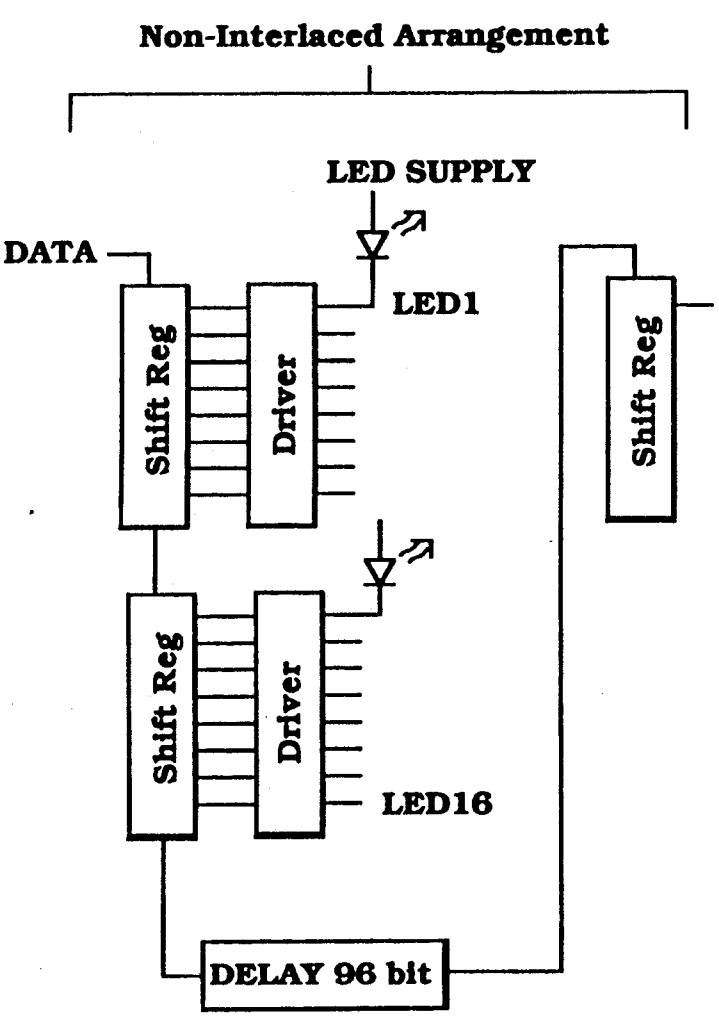
Figure 2A Prior Art
FIG. 2A is a block diagram of the non-interlaced arrangement in accordance with the invention forming the subject of Australian Patent Specification No. 493,435 (21004/76)
Figure 3:
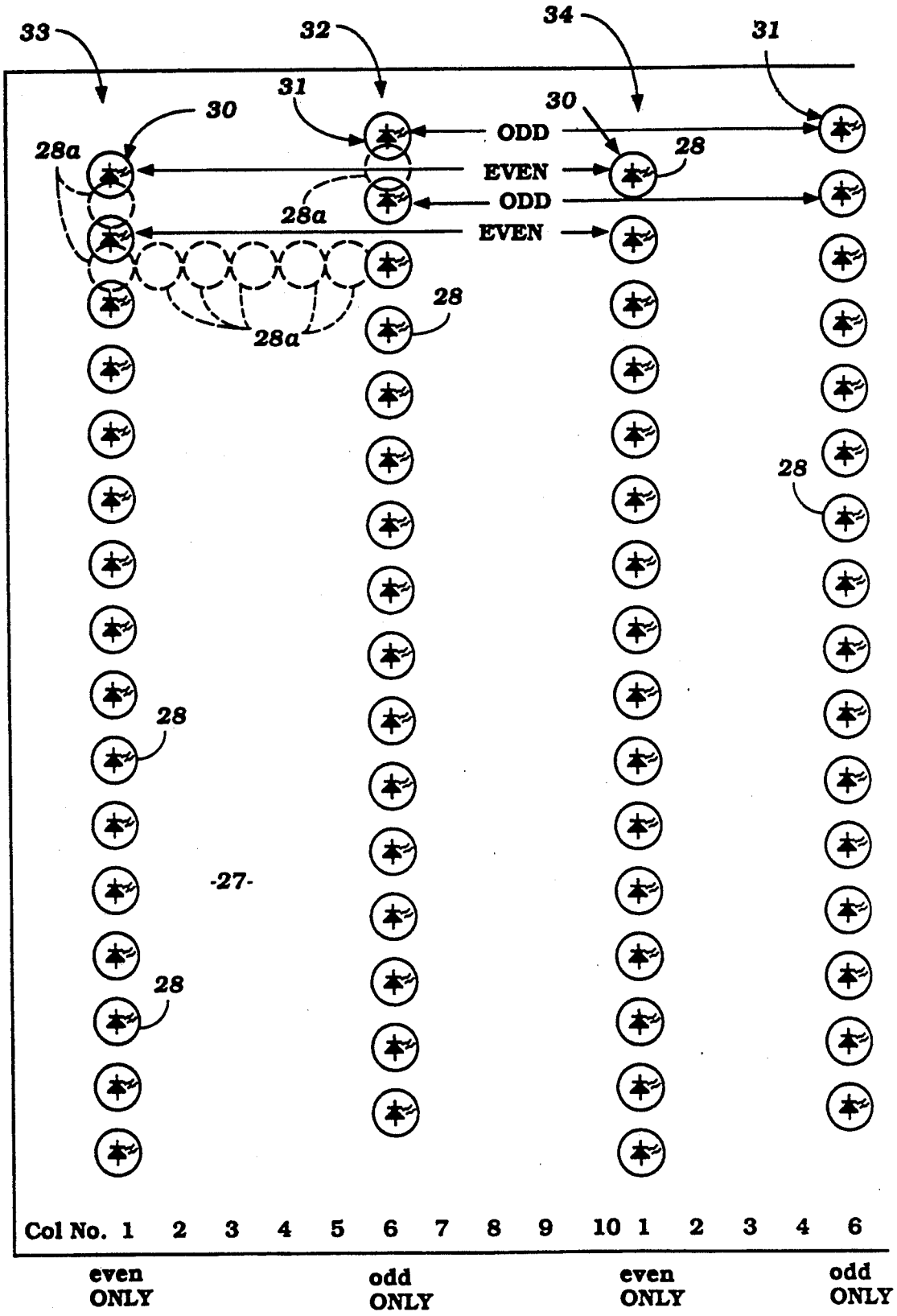
FIG. 3 is a schematic representation of part of the display area showing the relative locations of the image sources.
Figure 4:
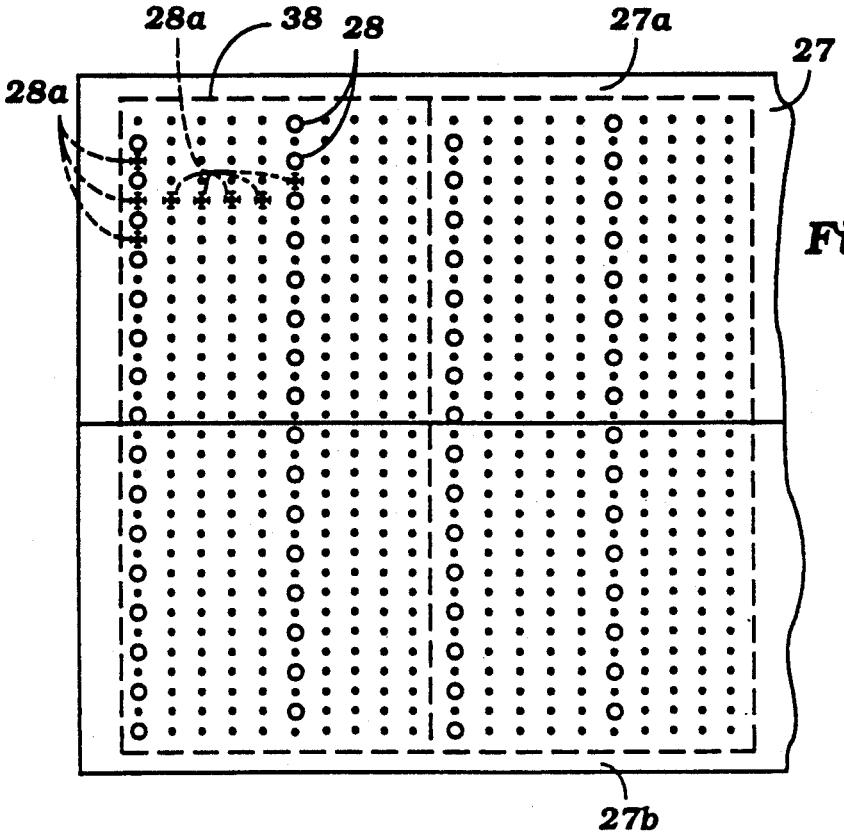
FIG. 4 is a schematic diagram of the display area showing the division of the area to facilitate addressing and physical location of the hardware.

The activating means 29 is shown in FIG. 2 and is associated with each column of image sources 28. The activating means consists of a storage means 35, an activating circuit means 36 and a further storage means 37. The storage means 35 is in the form of a pair of shift registers which receive serial data from the controller means 13 and store the same in storage elements within the register for subsequent parallel output of the data.

In the present embodiment, two shift registers of 8 bits each are provided in series to receive two successive 8 bit bytes of encoded data which make up a 16 bit word of encoded data for a column of the matrix. The parallel outputs of the shift registers are connected to the activating circuit means 36, which is in the form of a LED driver. The output of the driver is in turn connected to each of the image sources 28 within a particular column, wherein each image source is LED. Accordingly, encoded data is received serially from the controller means by the registers and is stored within storage elements located therein. In response to an actuating signal received from the controller means, the registers output the encoded data contained therein in parallel manner to the driver which in turn activates appropriate LED's within a column in accordance with the encoded data.

The further storage means 37 is in the form of a further shift register and is serially connected to the storage means 35 and to the next storage means 35' which forms part of the activating circuit for the successive column of image sources of the matrix. The further register is provided with a series of storage elements arranged to accept bytes of encoded data for each of the columns of the matrix disposed between successive columns having image sources. That is, the further register 37 is provided with bytes of storage each capable of handling 16 bits of encoded data and which are allocated one to each column of blank elements interposed between successive columns of image sources. For example, in one arrangement there may be 6 blank columns between successive columns of image sources, thereby in effect providing storage for 96 bits of data. Moreover, the further storage means 37 is arranged such that data stored therein is shifted in bytes serially through the register so that the last bytes of data therein is serially output in one such shift to the next shift register 35' wherein data is stored serially therein for display at the next display state period.

Thus, each column of image sources is provided with its own local storage means 35 and activating circuit 36. Furthermore, successive columns of image sources are interconnected by the further storage means 37 which is serially connected between the respective storage means 35 and 35' of the columns.

In the physical implementation of the present embodiment, and in view of the fact that the computing means is a Z80A processor, data is stored into bytes of 8 bits. Accordingly the column height is a multiple of 8 elements high. The storage means 35 is divided into two separate 8 bit shift registers (the display is divided into two separate 16 bit sections merely to keep the duty cycle as high as possible). Thus, in one transaction of encoded data, two shifts of 8 bits each are required to make up a 16 bit word of data. Thus, the display area is in fact divided into two halves 27*a* and 27*b* each having 8 image sources per column therein. In addition, the display area is divided into sections 38, wherein each section contains two columns of image sources and the columns of blank elements succeeding the same. It should also be appreciated that the height of display, and thus the resolution may be increased simply by the stacking of more sections 27*a* and 27*b* on top of each other.

Figure 5:
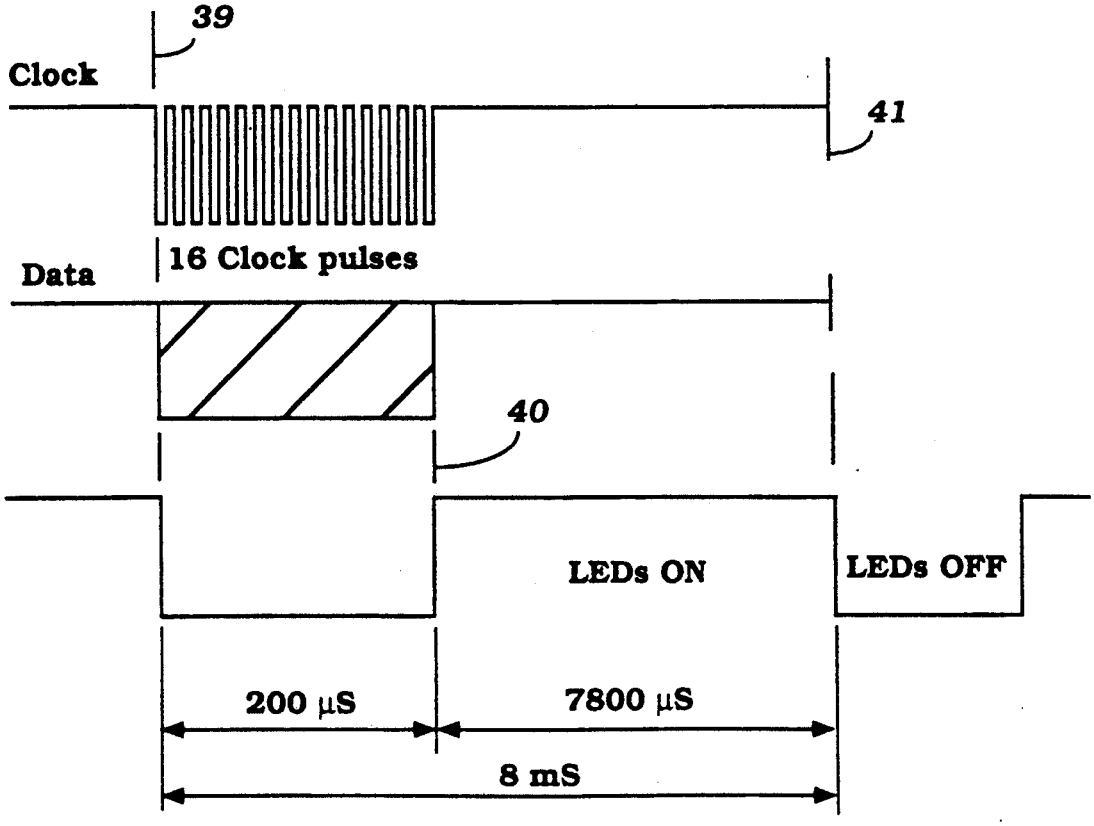
FIG. 5 is a timing diagram showing a typical cycle of a display state period.

The operation of the display system shall now be described with respect to displaying a graphic character on the display means and should be read with reference to FIG. 5 of the drawings.

The timing means 17 is arranged to commence the timing of the display state period at timing mark 39. Consequent to this a series of 16 clock pulses is issued whereupon 16 bits of encoded data representing a sample portion of a graphic to be represented by the first column of image sources at the display means are clocked to the display means. Each clocking pulse is used to serially load each bit of data in to the storage means 35 associated with the first column of image sources. Upon completion of the loading procedure, an actuating signal is generated by the computing means 14 at timing mark 40, which consequently outputs the encoded data stored within the storage means 35 to the activating means 36 and thus activates the LED's in the column at this prescribed instant.

Concurrent with this, the actuating signal is applied to the storage means of each of the columns having image sources so that the data contained within each of these storage means is simultaneously displayed with the first column.

This display continues until the timing means 17 times out the display state period at timing mark 41, whereupon another set of clock impulses is issued. Consequently, the next set of encoded data is transmitted to the storage means of the first column of LED's and loaded serially into the shift register thereof. This action causes the old data contained within the shift register to be serially loaded into the first byte of storage in the further storage means 37, which in turn causes a sequential shift of each of the bytes of data stored therein. The last byte of data being loaded into the next storage means 35'. After the last clock pulse, the actuating signal is generated and the new set of data is displayed.

Accordinly, a sequential shift of the displayed information is generated at the end of each display state period and during the display state period a static representation of the graphic is displayed.

Accordingly, as perceived by a viewer of the display area, the image of the graphic character is seen to move across the area, apparently in its complete form.

The typical timing of this sequence of events is such that the 16 clocking pulses are generated over a time period of 200 microseconds and the duration of the display state period is approximately 8 milliseconds. Accordingly, it can be seen that a high duty cycle is provided which enables a relatively high lumination of the image sources during the operation of the device. It should be appreciated that this duty cycle can be modified to accommodate a parallel loading and latching arrangement. Parallel loading is none efficient up to 8 intermediate columns of blank elements between successive image sources in a row. However, sequential loading is none efficient at greater than 8 columns.

The aforementioned embodiment relates principally to the use of a serial version of displaying encoded data of a graphic. It should be appreciated, however, that the particular mode of transferring data from the controller means to the display means is not essential ingredient of the present invention and that a parallel version of transferring data is still embraced within the scope of the present invention. One example of a parallel version which can be easily adapted to the present invention is described in Australian Patent Specification No. 493435 (21004/76). Furthermore, the present invention may be adapted to operate bidirectionally, wherein data may be applied to the display means so that the apparent movement of the graphic image may progress selectively in either direction along the display area.

It should be appreciated that an important feature of the present invention with respect to the aforementioned embodiment, is that the image sources for LED's are of such a size that each element in one matrix overlaps vertically with its nearest neighbours in adjacent rows of the matrix. This vertical overlap has the effect of enhancing beta apparent motion so minimising the tendency of the image to break into momentary fragments and in extending the separation between image elements centered on a line parallel to the direction of movement of the image. Furthermore, the interlacing effect of image sources also makes possible the display of stationary graphics of lower resolution by improving the spatial distribution of image sources and hence allowing limited resolution of a stationary graphic.

Another important aspect is that the interlacing effect enables up to 20 intermediate columns of blank elements to be provided between successive image sources in any row of the matrix, without severely debilitating the resolution of the graphic image displayed. However, for optimum performance, the number of blank columns should number from anywhere between 7 to 14. This is a significant improvement when compared with the number of blank columns that could be provided in the previous invention described in Australian Patent Specification No. 493435 (21004/76).

Another advantage of the present arrangement is that a specific image source may in fact comprise a number of light sources of different colours to achieve full colour graphics in accordance with the laws of colour mixture. In addition, it may be possible to use different colours of light sources in alternating columns to achieve a coloured effect.

Another feature of the present arrangement is that by adopting a computer system of type hereindescribed, it is possible to connect the display system into networks via the SCC 18. Accordingly, this may be encrypted and thus accessible only by password so that a particular display system may display a mixture of messages derived from a local source and messages transmitted via a network from a central controller.

Furthermore, the overlapping arrangement of image sources in successive rows mitigates the tendency for the image to jitter or wobble in the direction orthogonal to the direction of movement of the image.

It should be appreciated that the scope of the present invention is not limited to the scope of the particular embodiment herein described.

We claim:

1. A display system for depicting a moving image of a graphic of the type herein defined comprising:

(i) a display means having a display area and an activating means; said display area being defined by an array of first and second groups of elements arranged in the form of a matrix having a series of rows and columns, each element of said first and second groups forming a cell of the matrix, said rows being arranged parallel to the intended direction of movement of said image and said columns being arranged orthogonal to said intended direction of movement; and wherein said element of said first and second groups is an image source operable to emit an image, said image being a portion of said graphic on activation thereof, said first group of elements located in selected rows of said matrix, wherein successive elements of said first group in the same row are spaced apart by one or more columns having a group of coplanar, non-image source elements in said same row which do not emit a portion of said graphic, and a second group of elements of similar formation to said first group of elements but located in other selected rows of said matrix, wherein said second group of elements are disposed in interlacing fashion relative to said first group such that one element of said second group is disposed intermediate to a pair of successive elements of said first group in an adjacent row to the row of said one element, and a cell occupied by an image source in one said group of elements partially overlaps with an immediately adjacent cell in the same column, said adjacent cell being defined by a non-image source element disposed in a row of another said group of elements; and said activating means being associated with each of said image sources to activate an image source in response to the generation of a corresponding electrical signal; and (ii) a controller means for generating a set of said electrical signals in sequential groups, each set providing encoded data of a sample portion of said graphic to be represented by one column of said matrix at a prescribed instant, and successive groups of said sets providing further encoded data of successive sample portions of said graphic to be represented by said one column at successive prescribed instants, the period between successive prescribed instants being a display state period of said image, said encoded data being sequentially provided to be represented by successive columns of said matrix at said successive prescribed instants, wherein only those rows of image sources within a column of said matrix are activated for which an electrical signal has been generated in accordance with said encoded data.

2. A display system as claimed in claim 1, wherein said display state period is typically 8 milliseconds.

3. A display system as claimed in claim 1, wherein the image sources are arranged in discrete lines within selected columns, orthogonal to the intended direction of movement of said image.

4. A display system as claimed in claim 1, wherein said successive image sources within the same row are spaced apart by equal intervals of said non-image source elements.

5. A display system as claimed in claim 4, wherein said equal interval of non-image source elements may number up to 20 columns of non-image source elements in said row, and is typically 7 to 14.

6. A display system as claimed at claim 1, wherein said controller means includes computing means having memory means, control means and communication means, said memory means having facility for storage of a reference set of graphic characters in the form of groups of encoded data located in a look-up table, from which relevant encoded data may be provided to said display means in respect of a particular graphic which is desired to be displayed at said display area in response to a communication received by said communication means.

7. A display system as claimed in claim 1 wherein said activating means includes a storage means for a column of said matrix having an image source, said storage means having a storage element of each element in said column, and an activating circuit means to activate said image source in response to the generation of an actuating signal by said controller means, whereby a set of encoded data prescribed for said column is stored within said storage means prior to commencement of a display state period and said image source is activated in response to said actuating signal, dependent upon whether a said electrical signal is stored within the storage element corresponding to said image source on commencement of said display state period.

8. A display system as claimed in claim 7, wherein said activating means includes a further storage means associated with one or more successive columns not having an image source disposed therein and having a further storage element for each element in said associated column, whereby by a set of encoded data prescribed for said associated column is stored within said storage means prior to commencement of a display state period and transferred to a successive storage means on completion of said display state period and prior to the commencement of the next display state period.

9. A method of depicting a moving image of a graphic of the type herein defined on a display means having a display area being defined by an array of elements arranged in the form of a matrix having a series of rows and columns, each element forming a cell of the matrix, and rows being arranged parallel to the intended direction of movement of said image and said columns being arranged orthogonal to said intended direction of movement; a first group of elements, each element of said first group being an image source operable to emit a portion of said graphic on activation thereof, said first group of elements located in selected rows of said matrix, wherein successive elements of said first group in the same row are spaced apart by one or more columns having non-image source elements in said same row which do not emit a portion of said graphic, and a second group of elments of similar formation to said first group of elements but located in other selected rows of said matrix, wherein said second group of elements are disposed in a coplanar and interlacing fashion relative to said first group such that one element of said second group is disposed intermediate a pair of successive elements of said first group in an adjacent row to the row of said one element, and a cell occupied by an image source in one set group of elements partially overlaps with an immediately adjacent cell in the same column, said adjacent cell being defined by a non-image source element disposed in a row of another said group of elements; and said activating means being associated with each of said image sources to activate an image source in response to the generation of a corresponding electrical signal, the method comprising the steps of generating a set of said electrical signals in sequential groups, each set providing encoded data of a sample portion of said graphic to be represented by one column of said matrix at a prescribed instant, and successive groups of said sets providing further encoded data of successive sample portions of said graphic to be represented by said one column at successive prescribed instants, the period between succesive prescribed instants being a display state period of said image, said encoded data being sequentially provided to be represented by successive columns of said matrix at said successive prescribed instants, wherein only those rows of image sources within a column of said matrix are activated for which an electrical signal has been generated in accordance with said encoded data.

10. A method as claimed at claim 9, wherein said display state period is typically 8 milliseconds.

11. A method as claimed at claim 9, wherein the image sources are arranged in discrete lines within selected columns, orthogonal to the intended direction of movement of said image.

12. A method as claimed in claim 9, wherein said successive image sources within the same row are spaced apart by equal intervals of said non-image source elements.

13. A method as claimed in claim 12, wherein said equal interval of non-image source elements may number up to 20 columns of non-image source elements in said row, and is typically 7 to 14.

14. A method as claimed in claim 9, wherein the method includes providing relevant encoded data to said display means in respect of a particular graphic which is desired to be displayed at said display area in response to a communication received by a communication means by obtaining said relevant encoded data from a memory means having facility for storage of a reference set of graphic characters in the form of groups of encoded data located in a look-up table.

15. A method as claimed in claim 9, wherein the activating means includes a storage means for a column of said matrix having an image source, said storage means having a storage element for each element in said column, and an activating circuit means to activate said image source in response to the generation of an actuating signal by said controller means, whereby a set of encoded data prescribed for said column is stored within said storage means prior to commencement of a display state period and said image source is activated in response to said actuating signal, dependent upon whether a said electrical signal is stored within the storage element corresponding to said image source on commencement of said display state period.

16. A method as claimed in claim 15, wherein said activating means includes a further storage means associated with one or more successive columns not having an image source disposed therein and having a further storage element for each element in said associated column, whereby a set of encoded data prescribed for said associated column is stored within said storage means prior to commencement of a display state period and transferred to a successive storage means on completion of said display state period and prior to the commencement of the next display state period.

* * * * *